US011709034B1

(12) United States Patent
Goldstein

(10) Patent No.: US 11,709,034 B1
(45) Date of Patent: Jul. 25, 2023

(54) BELLY BAND WITH A STRUCTURALLY REINFORCED HOLSTER POCKET

(71) Applicant: Avraham Goldstein, Fort Lauderdale, FL (US)

(72) Inventor: Avraham Goldstein, Fort Lauderdale, FL (US)

( * ) Notice: Subject to any disclaimer, the term of this patent is extended or adjusted under 35 U.S.C. 154(b) by 0 days.

(21) Appl. No.: 17/463,827

(22) Filed: Sep. 1, 2021

Related U.S. Application Data

(63) Continuation-in-part of application No. 16/994,334, filed on Aug. 14, 2020, now abandoned.

(51) Int. Cl.
*F41C 33/02* (2006.01)
*F41C 33/04* (2006.01)

(52) U.S. Cl.
CPC ..... *F41C 33/046* (2013.01); *F41C 33/0209* (2013.01); *F41C 33/048* (2013.01)

(58) Field of Classification Search
CPC .. F41C 33/048; F41C 33/0209; F41C 33/046; F41C 33/0239; Y10S 224/911
USPC ..... 224/660, 666, 667, 662
See application file for complete search history.

(56) References Cited

U.S. PATENT DOCUMENTS

| | | | | |
|---|---|---|---|---|
| 9,891,021 | B2 | 2/2018 | Galoob | |
| 2011/0220696 | A1* | 9/2011 | Buchanan | A45F 5/00 224/191 |
| 2014/0097216 | A1 | 4/2014 | Rogers | |
| 2015/0115005 | A1 | 4/2015 | Slinkard | |
| 2022/0362924 | A1* | 11/2022 | St-Laurent | B25H 3/00 |

* cited by examiner

*Primary Examiner* — Corey N Skurdal

(57) ABSTRACT

A belly band that is configured to be worn by, and secured around a waist of, a person is disclosed. The belly band is particularly configured to carry and conceal a firearm around the person's waist. The belly band includes a flexible band that secures the belly band to a person's waist. The belly band further includes a pocket this is integrally formed with or connected to the front side, with the pocket being configured to receive and hold a rigid firearm holster. In addition, the pocket of the belly band includes a top edge that is structurally reinforced (to assist in holding and stabilizing the rigid firearm holster and, particularly, to receive the clips of such holsters that are normally secured to traditional belts). Still further, the belly band includes an attachment means that is configured to reversibly connect the belly band to a person's waist.

8 Claims, 9 Drawing Sheets

BELLY BAND WITH A STRUCTURALLY REINFORCED HOLSTER POCKET

CROSS-REFERENCE TO RELATED APPLICATIONS

This application is a continuation-in-part of U.S. patent application Ser. No. 16/994,334, filed on Aug. 14, 2020.

FIELD OF THE INVENTION

The field of the present invention relates to belly bands. More particularly, the field of the present invention relates to belly bands that can be used to carry and conceal a firearm.

BACKGROUND OF THE INVENTION

In today's world, the need for adequate self-defense measures is greater than ever before. Indeed, the escalation of crime rates across the United States—and particularly violent crime—underscores the need for law abiding citizens to adopt effective self-defense measures. Of course, many individuals choose to carry firearms as a self-defense measure. However, safely, comfortably, and discreetly carrying a firearm can be difficult.

To solve this problem, belly bands have been utilized by members of the public, which are adapted to be worn around the torso or waist of a person, sometimes underneath a shirt and/or pants of a person. Such currently-available belly bands, however, suffer from a number of drawbacks. For example, none of the currently-available belly bands are able to adequately support a heavier/rigid firearm holster, e.g., a holster comprised of heavier plastic or metal. That is, the currently-available belly bands include sleeves, pockets, or other areas that are too flimsy and, thus, not structurally configured to adequately and safely support a heavier; rigid firearm holster.

As the following will demonstrate, the belly bands of the present invention address these (and other) needs in the marketplace.

SUMMARY OF THE INVENTION

According to certain aspects of the present invention, belly bands that are configured to be worn by, and secured around a waist of, a person are disclosed. The belly bands are particularly configured to carry and conceal a firearm around the person's waist. The belly bands include a flexible band having a top side, a bottom side, a left side, a right side, a front side, and a back side. The belly bands further include a pocket this is integrally formed with or connected to the front side, with the pocket being configured to receive and hold a rigid firearm holster (which differs from prior art belly bands, which are configured to hold firearms and not rigid firearm holsters). In addition, the pocket of the belly bands includes a top edge that is structurally reinforced, to assist in holding and stabilizing the rigid firearm holster. The invention further provides that the size and thickness of the structurally reinforced top edge resembles that of a standard belt, such that it may secure current in-the-waistband (IWB) gun holsters that normally clip onto a traditional belt. Still further, the belly bands include an attachment means that is configured to reversibly connect the belly bands to a person's waist.

The above aspects of the present invention are described and exemplified further in the Detailed Description set forth below.

DETAILED DESCRIPTION OF THE INVENTION

Figure 1:
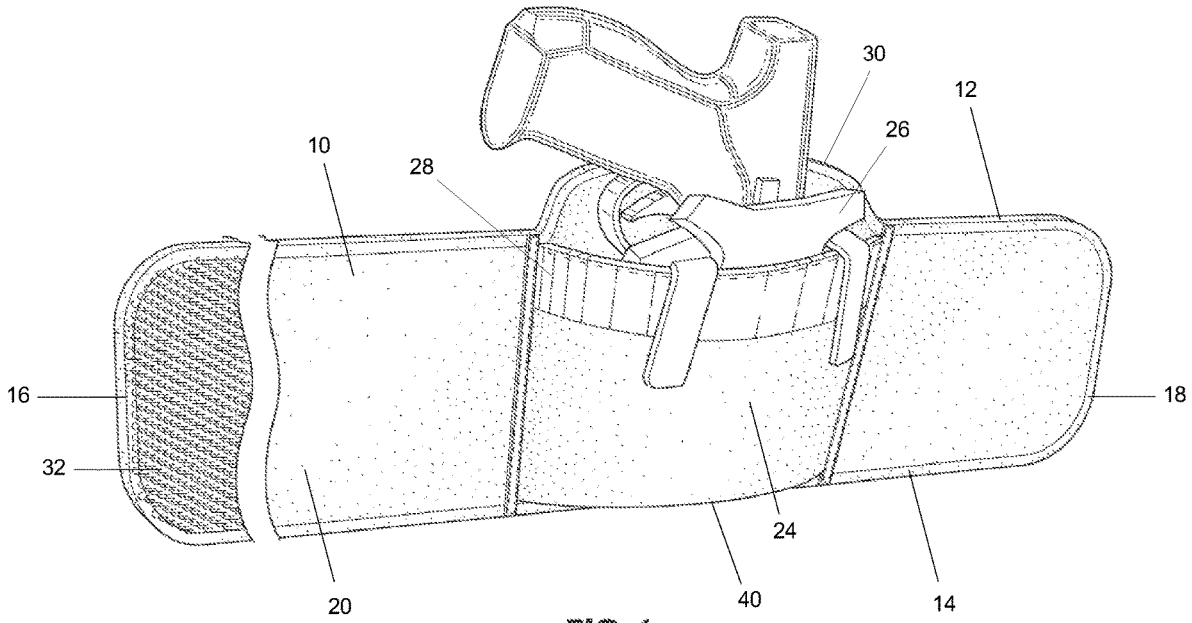
FIG. 1 is an elevated perspective view of a first embodiment of a belly band of the present invention, showing the structurally reinforced holster pocket holding a rigid holster and firearm.
Figure 2:
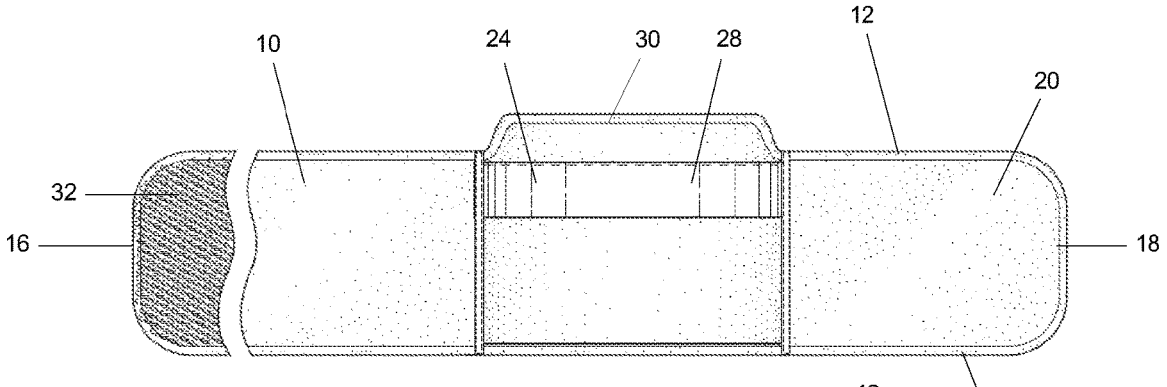
FIG. 2 is a front view of the belly band of FIG. 1.
Figure 3:
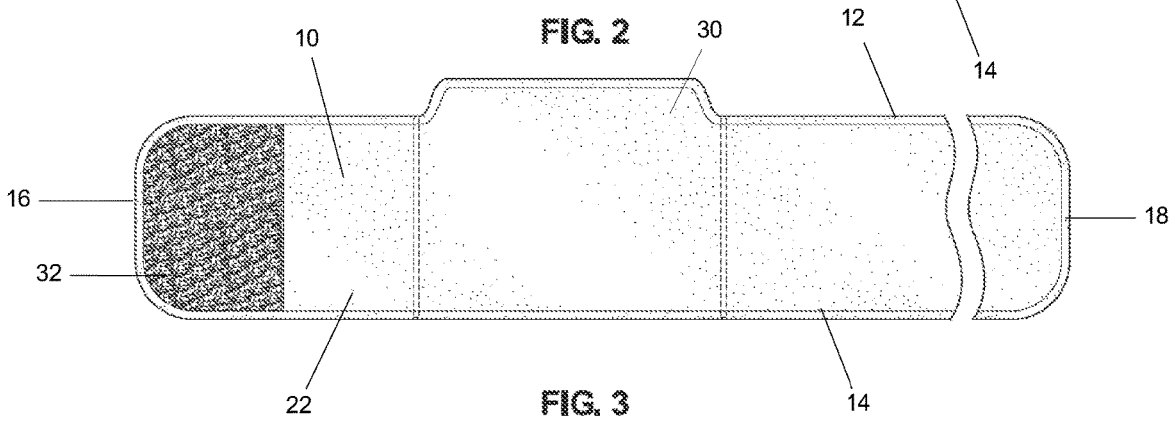
FIG. 3 is a back view of the belly band of FIG. 1.
Figure 4:
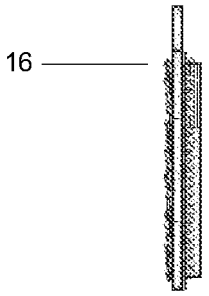
FIG. 4 is a left side view of the belly band of FIG. 1.
Figure 5:
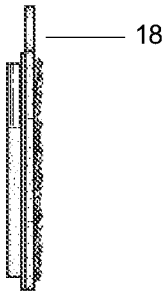
FIG. 5 is a right side view of the belly band of FIG. 1.
Figure 6:
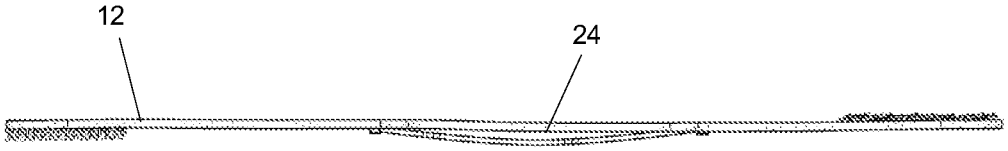
FIG. 6 is a top view of the belly band of FIG. 1.
Figure 7:
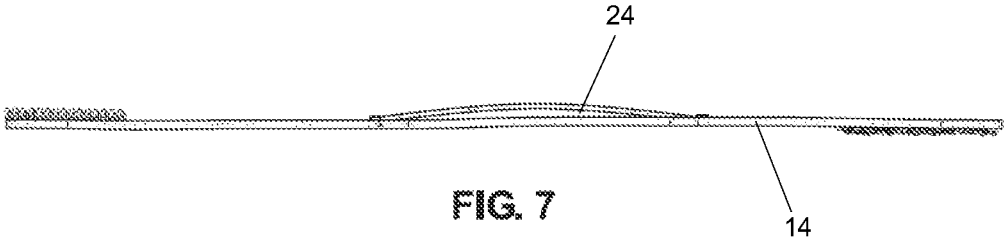
FIG. 7 is a bottom view of the belly band of FIG. 1.

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used, and made without departing from the scope and spirit of the invention.

Referring now to FIGS. 1-16, according to certain preferred embodiments of the present invention, belly bands are provided that are configured to be worn by, and secured around a waist or abdomen of, a person. The belly bands are particularly configured to carry and conceal a firearm around the person's waist—and, more specifically, the belly bands are configured to hold and support a rigid holster (which in turn holds and conceals a person's firearm). As explained below, the belly bands of the present invention include a pocket having a structurally reinforced top edge, with such top edge exhibiting a size and thickness that resembles that of a standard belt, such that it may secure current in-the-waistband (IWB) gun holsters that normally clip onto a traditional belt.

Example-1

According to a first preferred embodiment (FIGS. 1-8), belly bands of the present invention include a flexible band 10 having a top side 12, a bottom side 14, a left side 16, a right side 18, a front side 20, and a back side 22. The belly bands further include a sleeve or pocket 24 this is integrally formed with or connected to the front side 20 of the belly band, with the pocket 24 being configured to receive and hold a rigid firearm holster 26. In addition, the pocket 24 of the belly bands includes a top edge 28 that is structurally reinforced (to assist in holding and stabilizing the rigid firearm holster 26). The invention provides that the bottom edge 40 of the pocket 24 may be configured to be open or closed (i.e., connected at or near the bottom side 14 of the belly band).

More particularly, the invention provides that the flexible band 10 portion of the belly band may be comprised of a suitably flexible and comfortable material, e.g., textiles, fabrics, cloth, felt, polyesters, nylon, flexible plastics, synthetic rubbers (such as polychloroprene), and/or other suitably flexible materials that are comfortable to wear. In such embodiments, the top edge 28 of the pocket 24 is comprised of a rigid material selected from the group consisting of leather, rubber, elastomers, rigid plastics, metals, synthetic polymers, and combinations of such rigid materials. Importantly, the invention provides that the top edge 28 of the pocket 24 will be more rigid and structurally reinforced, compared to an area of the pocket 24 below the top edge 28. In certain preferred embodiments, the invention provides that the top edge 28 of the pocket 24 preferably consists of a rigid material that is sewn into the top edge 28 of the pocket 24—e.g., a rigid Nylon material (a rigid synthetic polymer that includes aliphatic and/or semi-aromatic polyamides).

According to such preferred first embodiment, the pocket 24 may further include a top lip 30 that extends beyond the top edge 28 of the pocket 24—and beyond remaining areas of the top side 12 of the belly band. The invention provides that the top lip 30 is preferably integrally formed with the back side 22 of the belly band. In other words, the area of the flexible band 10 that forms the backside of the pocket 24 may be configured to extend beyond the top edge 28 of the pocket 24 and the remaining areas of the top side 12 of the belly band (FIG. 3)—to form the separate top lip 30. The invention provides that the top lip 30 will preferably serve as a comfortable barrier between the rigid firearm holster 26 and a person's body during use.

According to still further embodiments, the belly bands preferably include an attachment means 32 that is configured to reversibly connect the left sides 16 and right sides 18 of the belly bands to each other (i.e., to surround and secure the belly bands to the waist or torso of a person). The invention provides that such attachment means 32 may include clasps, snaps, magnets, zippers, hook-and-loop materials, and other attachment means. In certain preferred embodiments, however, the attachment means 32 consists of a set of corresponding hook-and-loop materials (e.g., an area of about 50 mm×38 mm that exhibits corresponding hook-and-loop materials), such that the belly band may be easily and quickly applied to and removed from a person's waist or torso.

Figure 8:
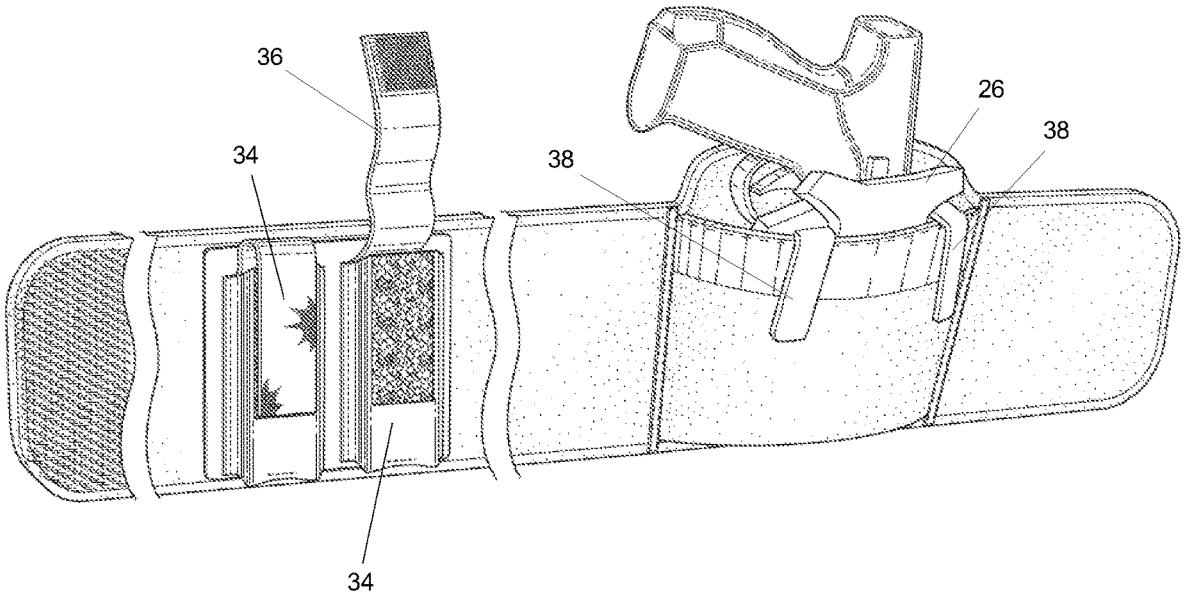
FIG. 8 is another elevated perspective view of the belly band of FIG. 1, showing the structurally reinforced holster pocket holding a rigid holster and firearm, which further includes two compartments for holding ammunition cartridges/magazines.
Figure 9:
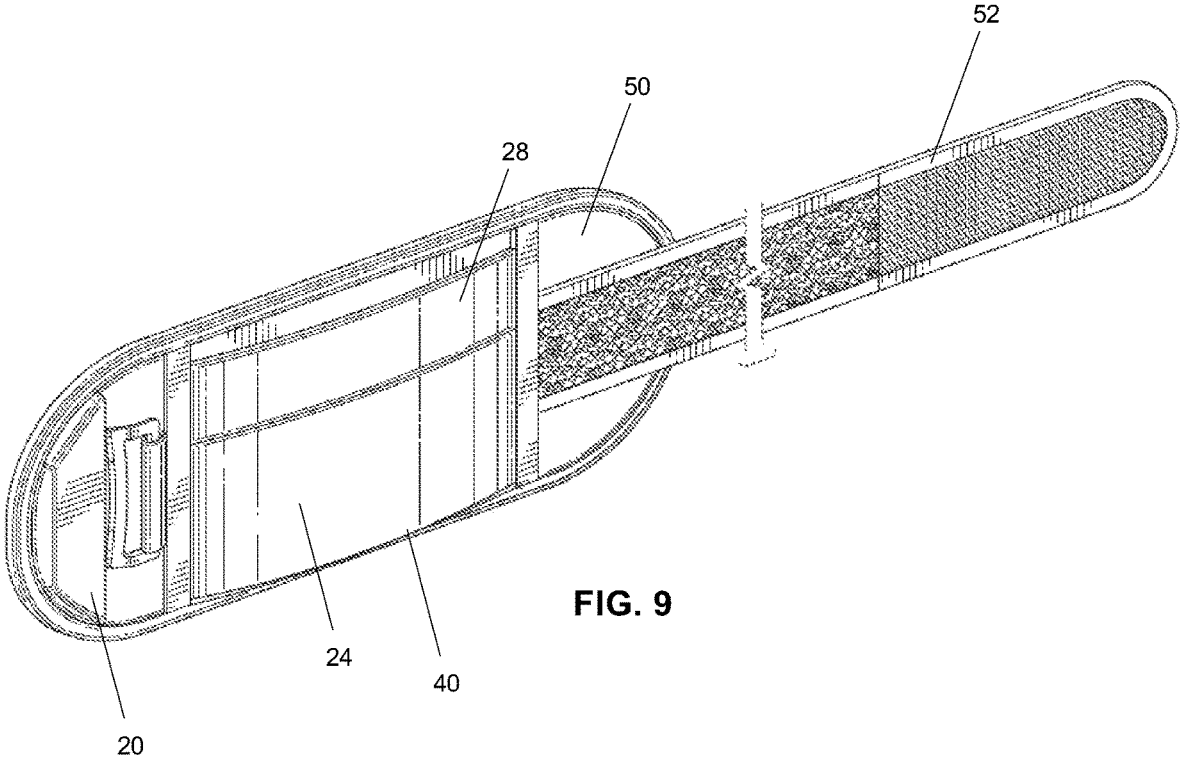
FIG. 9 is an elevated perspective view of a second embodiment of a belly band of the present invention.

Referring now to FIG. 8, in certain embodiments, the belly bands of the present invention may include one or more compartments 34 that are configured to hold and carry ammunition magazines. The invention provides that such compartments 34 may be configured as a sleeve or pocket, which exhibits an internal dimension that is configured to nestably receive an ammunition magazine. The compartments 34 may include a cover or flap 36, which is configured to retain an ammunition magazine within the compartment 34. The invention provides that the cover or flap 36 may be opened or closed as desired, e.g., with the flap being converted into a closed position through any of various mechanical attachment means, such as clasps, snaps, magnets, zippers, hook-and-loop materials, and other attachment means.

The invention provides that the belly bands described herein may exhibit various sizes and dimensions. By way of example, and only for the purpose of illustration, in the embodiment shown in FIGS. 1-8, the distance between the top side 12 and the bottom side 14 may be about 5.5 inches; the distance between the left side 16 and right side 18 may be about 45 inches; the pocket 24 may exhibit a width of about 8.5 inches and a height of about 5 inches; and the top lip 30 may extend beyond the top edge 28 of the pocket 24 by about an inch. In certain exemplary embodiments, the compartments 34 may exhibit a width of about 50 mm and a height of about 100 mm.

Example-2

Figure 16:
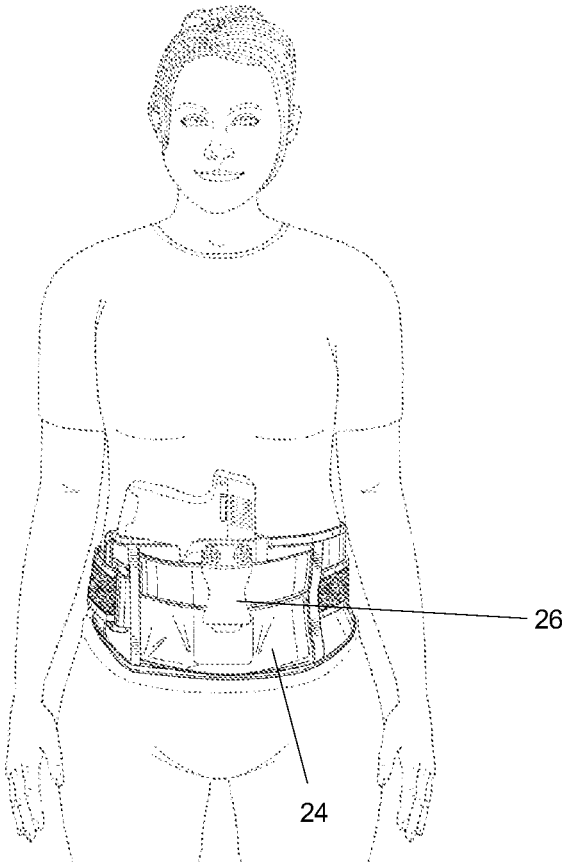
FIG. 16 is a view of the belly band of FIG. 9 being worn by a person.

The invention further encompasses a second preferred embodiment (FIGS. 9-16), which is similar to the belly bands described above in relation to FIGS. 1-8. In this second preferred embodiment, the belly bands include a belly panel 50 that is connected to a waist band 52. The belly panel 50 is preferably larger than the waist band 52, with the belly panel 50 including the sleeve or pocket 24 described herein. In such embodiments, the sleeve or pocket 24 is integrally formed with or connected to the front side 20 of the belly panel 50, with the pocket 24 being configured to receive and hold a rigid firearm holster 26 as described herein (FIG. 16). As described above, the invention provides that the bottom edge 40 of the pocket 24 may be configured to be open or closed.

As with the first embodiment described above, the pocket 24 of the belly bands of this second embodiment includes a top edge 28 that is structurally reinforced (to assist in holding and stabilizing the rigid firearm holster 26). The invention provides that the structurally reinforced top edge 28 will exhibit a size and thickness that resembles that of a standard belt, such that the top edge 28 may secure current in-the-waistband (IWB) gun holsters 26 that normally clip onto a traditional belt. For example, the structurally reinforced top edge 28 may exhibit a height 76 of 1 inch to 2 inches (FIG. 10), and a thickness of at least 1/16 of an inch, at least 1/8 of an inch, at least 1/4 of an inch, or thicker.

Figure 10:
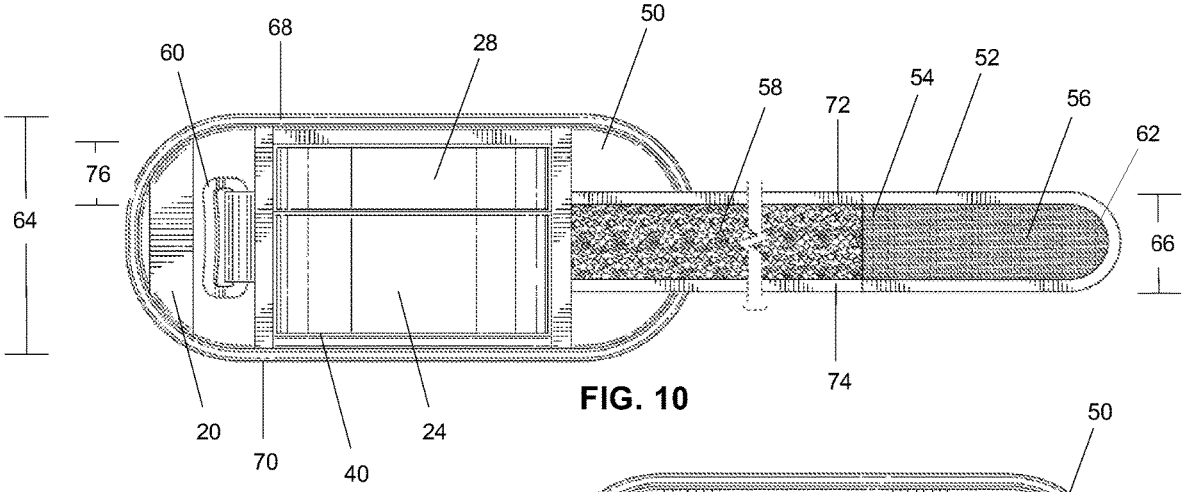
FIG. 10 is a front view of the belly band of FIG. 9.
Figure 11:
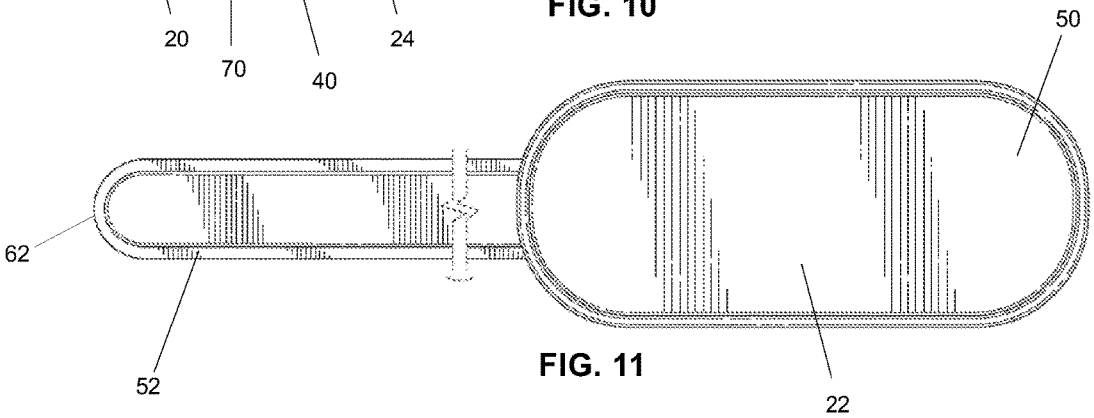
FIG. 11 is a back view of the belly band of FIG. 9.
Figure 12:
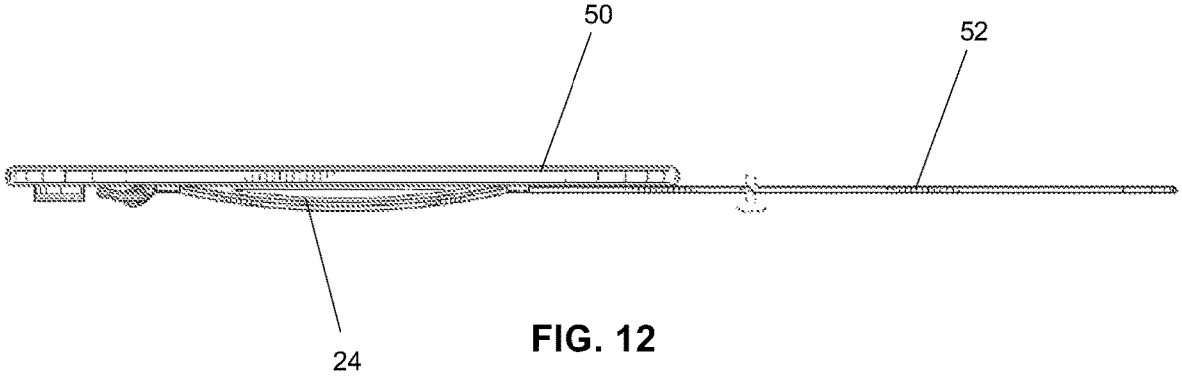
FIG. 12 is a top view of the belly band of FIG. 9.
Figure 13:
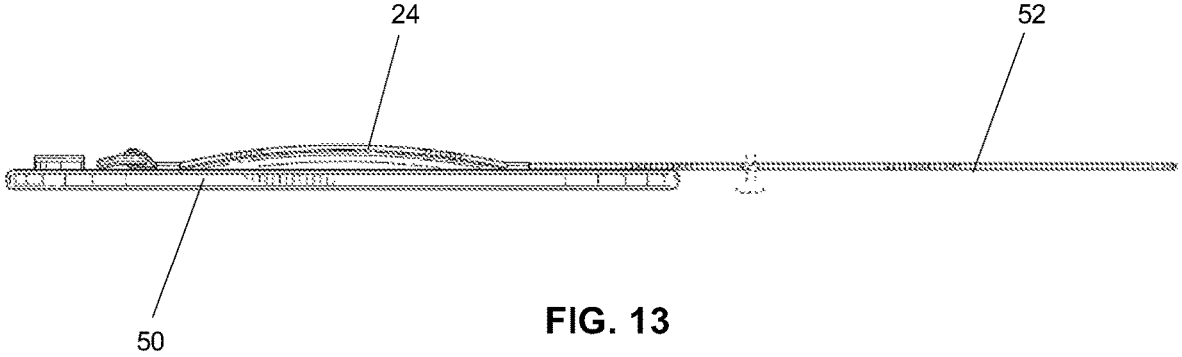
FIG. 13 is a bottom view of the belly band of FIG. 9.
Figure 14:
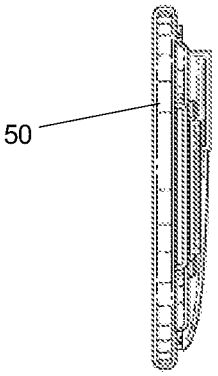
FIG. 14 is a left side view of the belly band of FIG. 9.
Figure 15:
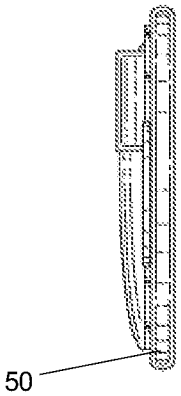
FIG. 15 is a right side view of the belly band of FIG. 9.

As mentioned above, the belly panel 50 is preferably larger than the waist band 52, i.e., the height 64 of the belly panel 50 will be larger than the height 66 of the waist band 52 (FIG. 10). The height 64 of the belly panel 50 will be the distance between the top side 68 and bottom side 70 of the belly panel 50; whereas, the height 66 of the waist band 52 will be the distance between the top side 72 and bottom side 74 of the waist band 52. In some cases, the height 64 of the belly panel 50 will be at least 1.5×, 1.75×, 2×, 2.5×, or at least 3×greater than the height 66 of the waist band 52. This configuration and differential in heights provides preferred surface area for the belly panel 50 to hold and accommodate the pocket 24, while not adding unnecessary material and surface area to the waist band 52 that travels around and is secured to portions of a person's torso.

As with the first embodiment described above, the top edge 28 of the pocket 24 is comprised of a rigid material selected from the group consisting of leather, rubber, elastomers, rigid plastics, metals, synthetic polymers, and combinations of such rigid materials—such that the top edge 28 of the pocket 24 will be more rigid and structurally reinforced, compared to an area of the pocket 24 below the top edge 28. As explained above, the invention provides that the top edge 28 of the pocket 24 preferably consists of a rigid material that is sewn into the top edge 28 of the pocket 24—e.g., a rigid Nylon material (a rigid synthetic polymer that includes aliphatic and/or semi-aromatic polyamides). The invention provides that top edge 28 of the pocket 24 will preferably be at least 1.5×, 2×, 3×, 4×, 5×, 10×, 20×, or at least 50× or more rigid than the area of the pocket 24 below the top edge 28. The invention provides that the rigidity of such areas of the belly band may be compared to each other by comparing Young's modulus measurements of such materials. In such embodiments, the structurally reinforced top edge 28 of the pocket 24 is configured to, and is capable of, securely holding the clips of current in-the-waistband (IWB) gun holsters 26—without the aid of an additional belt.

In such embodiments, the waist band 52 extends from a first side of the belly panel 50 (e.g., at or near a first side of the pocket 24). The front side 54 of the waist band 52 includes two areas 56/58 having complementary hook-and-loop materials. For example, the waist band 52 may include a first area 56 having hook material, with a second area 58 having a loop material. The belly bands of such embodiments further include a buckle element 60 located at or near a second side of the belly panel 50 (e.g., at or near a second side of the pocket 24, i.e., an opposite side of the pocket 24 from which the waist band 52 originates and extends).

In certain embodiments, the buckle element 60 will include an aperture having a size and dimension that is configured to allow the waist band 52 to be inserted therethrough. When the belly band is secured to a person, the invention provides that the belly panel 50 is positioned adjacent to a person's abdomen (with the pocket 24 facing outward), such that the waist band 52 can then be wrapped around the person's back and brought to the other/opposite side of the belly panel 50 from which the waist band 52 originates and extends. The distal end 62 of the waist band 52 is then inserted through the buckle element 60, with the waist band 52 being pulled through the buckle element 60 to a position that the belly band is securely attached to the person's torso.

The distal end 62 of the waist band 52 is then folded back on itself in a way that the first area 56 thereof (having hook material) engages the second area 58 (having a loop material). An illustration of the belly band of this embodiment, secured to a person's torso, is shown in FIG. 16. The engagement of the hook-and-loop materials of the two areas 56/58 will then secure the belly band to the person (such that the belly band can later be removed by disengaging the hook-and-loop materials of the two areas 56/58 and pulling the waist band 52 out of the buckle element 60).

The invention provides that the belly bands described herein may be offered and sold as separate units. In other embodiments, the invention encompasses both the belly bands described herein, along with a rigid firearm holster 26. The invention provides that the rigid firearm holster 26 may be comprised of hard plastics, metals, and/or other suitably rigid materials. The rigid firearm holsters 26 may include one or more clasps 38, which are configured to receive, connect to, and rest on top of the top edge 28 of the pocket 24 (as shown in FIGS. 1, 8, and 16).

The many aspects and benefits of the invention are apparent from the detailed description, and thus, it is intended for the following claims to cover all such aspects and benefits of the invention, which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A belly band that is configured to be worn by and secured around a waist of a person, which comprises:

(a) a belly panel that has a top side, a bottom side, a front side, and a back side;

(b) a pocket that is integrally formed with or connected to the front side of the belly panel, wherein the pocket includes (i) a top edge that is structurally reinforced and (ii) a rigid firearm holster, wherein the top edge of the pocket is at least 3× more rigid than all other areas of the belly panel and the pocket below the top edge according to Young's modulus measurements;

(c) a waist band that is connected to and extends from a first side of the belly panel, wherein the waist band includes a first area having hook material and a second area having a loop material; and (d) a buckle element located at or near a second side of the belly panel, wherein the waist band is configured to be wrapped around the person's waist with a distal end of the waist band being configured to be inserted through the buckle element and folded back onto itself to reversibly attach the first area having hook material to the second area having a loop material.

2. The belly band of claim 1, wherein the top edge of the pocket is comprised of a rigid material selected from the group consisting of leather, rubber, elastomers, plastics, metals, synthetic polymers, and combinations of such rigid materials.

3. The belly band of claim 1, wherein a height of the belly panel is at least 2× greater than a height of the waist band.

4. The belly band of claim 1, wherein the top edge of the pocket (a) ranges between 1 inch and 2 inches in height and (b) is at least 5×more rigid than an area of the pocket below the top edge according to Young's modulus measurements.

5. The belly band of claim 1, wherein the top edge of the pocket (a) ranges between 1 inch and 2 inches in height and (b) is at least 10× more rigid than an area of the pocket below the top edge according to Young's modulus measurements.

6. A belly band that is configured to be worn by and secured around a waist of a person, which comprises:

(a) a belly panel that has a top side, a bottom side, a front side, and a back side;

(b) a pocket that is integrally formed with or connected to the front side of the belly panel, wherein (i) the pocket includes a top edge that is structurally reinforced; (ii) the top edge of the pocket is comprised of a rigid material selected from the group consisting of leather, rubber, elastomers, plastics, metals, synthetic polymers, and combinations of such rigid materials; (iii) the top edge of the pocket ranges between 1 inch and 2 inches in height; (iv) the top edge of the pocket is at least 3× more rigid than all other areas of the belly panel and an area of the pocket below the top edge according to Young's modulus measurements; and (v) the pocket includes a rigid firearm holster;

(c) a waist band that is connected to and extends from a first side of the belly panel, wherein the waist band includes a first area having hook material and a second area having a loop material, and wherein a height of the belly panel is at least 2× greater than a height of the waist band; and (d) a buckle element located at or near a second side of the belly panel, wherein the waist band is configured to be wrapped around the person's waist with a distal end of the waist band being configured to be inserted through the buckle element and folded back onto itself to reversibly attach the first area having hook material to the second area having loop material.

7. The belly band of claim 6, wherein the top edge of the pocket is at least 5× more rigid than an area of the pocket below the top edge according to Young's modulus measurements.

8. The belly band of claim 6, wherein the top edge of the pocket is at least 10× more rigid than an area of the pocket below the top edge according to Young's modulus measurements.

* * * * *